US006467447B1

(12) United States Patent
Holmes et al.

(10) Patent No.: US 6,467,447 B1
(45) Date of Patent: Oct. 22, 2002

(54) SPARK PLUG BOOT KEEPER ASSEMBLY

(75) Inventors: James C Holmes, Mineral Ridge; Suzanne Christine Nadasky, Newton Falls; Rhoda A Taylor, Cortland; Harry J. Slaven, Canfield, all of OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/907,064

(22) Filed: Jul. 17, 2001

(51) Int. Cl.[7] ..... F02P 1/00; H01R 13/44

(52) U.S. Cl. ..... 123/169 PA; 123/169 PH; 439/125; 439/127

(58) Field of Search ..... 439/125, 127; 123/143 C, 169 PA, 169 PM, 169 P

(56) References Cited

U.S. PATENT DOCUMENTS 5,632,636 A * 5/1997 Maekawa ..... 439/125
5,827,079 A * 10/1998 Murata ..... 439/125
6,193,528 B1 * 2/2001 Rea et al. ..... 439/127

* cited by examiner

*Primary Examiner*—Bibhu Mohanty
(74) *Attorney, Agent, or Firm*—Thomas N. Twomey

(57) ABSTRACT

A sparkplug boot keeper assembly interconnects between a heat shield and an ignition wire boot of a spark plug. A spring clip is pre-assembled internally to the heat shield which then engages a bottom portion of the spark plug after the spark plug is threaded to a head of an engine block. During assembly, as the heat shield moves axially inward over the spark plug, the pre-assembled spring clip rasps over a hexagonal portion of the spark plug and snap fits to the bottom portion. An outward facing surface of the boot is engaged to a compressed spring which in turn is engaged to an outward wall of the heat shield. Either a rotation, or an axially outward withdrawal force placed upon the heat shield, will radially expand the spring clip permitting disengagement of the heat shield and spring clip assembly from the stationary spark plug.

21 Claims, 7 Drawing Sheets

SPARK PLUG BOOT KEEPER ASSEMBLY

TECHNICAL FIELD OF THE INVENTION

This invention relates to a spark plug boot keeper assembly and more particularly to a spark plug boot keeper assembly of a combustion engine utilizing a heat shield.

BACKGROUND OF THE INVENTION

Spark plugs are known to have a male terminal protruding from an upper ceramic or terminal portion. A high voltage ignition wire terminal clip or female terminal is press fitted and thereby locks onto the male terminal of the spark plug. This high voltage electrical connection is surrounded by an elastomeric, electrically insulating boot which is integral to the ignition wire protruding from the top, and fits down snuggly around the upper ceramic portion of the spark plug. In addition to the boot's insulating characteristics, the boot also assures that the high voltage electrical connection remains clean and free of moisture thereby providing a strong and efficient spark within the combustion chamber.

In today's more complex combustion engines, the spark plug is often inserted into a deep spark plug well typically surrounded by an electrically grounded and heat dissipating engine block. After insertion into the well the spark plug is threadably engaged to the engine block. Because only the top of the spark plug is viewable when within the well, connection of the boot to the spark plug may be cumbersome. If the boot is not seated properly to the spark plug terminal, the strength of the resultant spark from the spark plug could be weakened, or the combustion process efficiency within a specific chamber might degrade thereby causing a rough running engine. Furthermore, repeated engagement and disengagement of the ignition wire to the spark plug during engine maintenance, or simply the vibration of a running engine itself, could weaken the female terminal clip causing the boot to disengage from the spark plug. Ensuring continuous and strong energy transmittal requires a commonly incorporated female terminal clip of a highly robust design. This robust or high strength design is expensive to manufacture and cumbersome to snap fit over the spark plug. Unfortunately, engineering a less expensive, weaker, female terminal could possibly cause the boot and terminal to unseat from the spark plug thereby producing a rough running engine and adding to warranty costs.

Furthermore, the spark plug and boot may be protected by a heat shield, also disposed within the well of the engine block, when heat dissipation from the engine block into the well is unusually high. The heat shield prevents the production of damaging hot spots on the elastomeric boot which could contribute to high voltage arcing from the ignition wire to the engine block, weakening the sparking characteristics of the spark plug. By surrounding the boot, the heat shield distributes and dissipates the otherwise damaging heat. Unfortunately, the heat shield must be installed into the well prior to threading the spark plug to the engine block. Therefore, the heat shield effectively narrows the spark plug well for purposes of seating the boot to the spark plug.

SUMMARY OF THE INVENTION

The present invention provides a spark plug boot keeper assembly which ensures that a spark plug boot is properly installed within a heat shield and locked onto a spark plug. The assembly has a spring clip which is pre-assembled to the heat shield via a locking extension protruding radially outward from the spring clip. The locking extension engages an axial inward facing surface of the heat shield. The locking extension preferably extends into a slot communicating through a wall of the heat shield and defined by the inward facing surface. The spring clip resiliently engages a bottom shelf of the heat shield which extends radially inward from the wall. A contact edge of the spring clip faces radially inward and engages or snap fits to a bottom portion of the spark plug after reeving over a radially protruding hexagonal portion of the spark plug during assembly.

A locking combination of the spark plug boot keeper assembly locks the boot to the spark plug by engaging the heat shield to an upward facing surface of the boot. An obstruction member of the locking combination extends radially inward from the wall of the heat shield disposed axially outward with respect to the outward facing surface of the boot. Preferably, a spring is compressed axially between the obstruction member and the outward facing surface of the boot thereby providing a constant axial inward force upon the boot. The heat shield and the pre-assembled spring clip can be withdrawn from the stationary spark plug upon a withdrawal force exerted on the heat shield causing the spring clip to expand radially outward.

A feature of the present invention is the ability to engage a heat shield to a spark plug pre-installed to the head of an engine block.

Another feature of the invention is providing a secondary means for securing the boot to the spark plug, other than the traditional ignition wire terminal clip snap fit engagement to the spark plug.

Yet another feature of the invention is reduced warranty costs by eliminating unintentional unseating of the boot from the spark plug and by providing a more robust electrical connection design.

BRIEF DESCRIPTION OF THE DRAWINGS

The presently preferred embodiments of the invention is disclosed in the following description and accompanying drawings wherein.

DETAILED DESCRIPTION OF THE PREFERRED EMBODIMENTS

Figure 1:
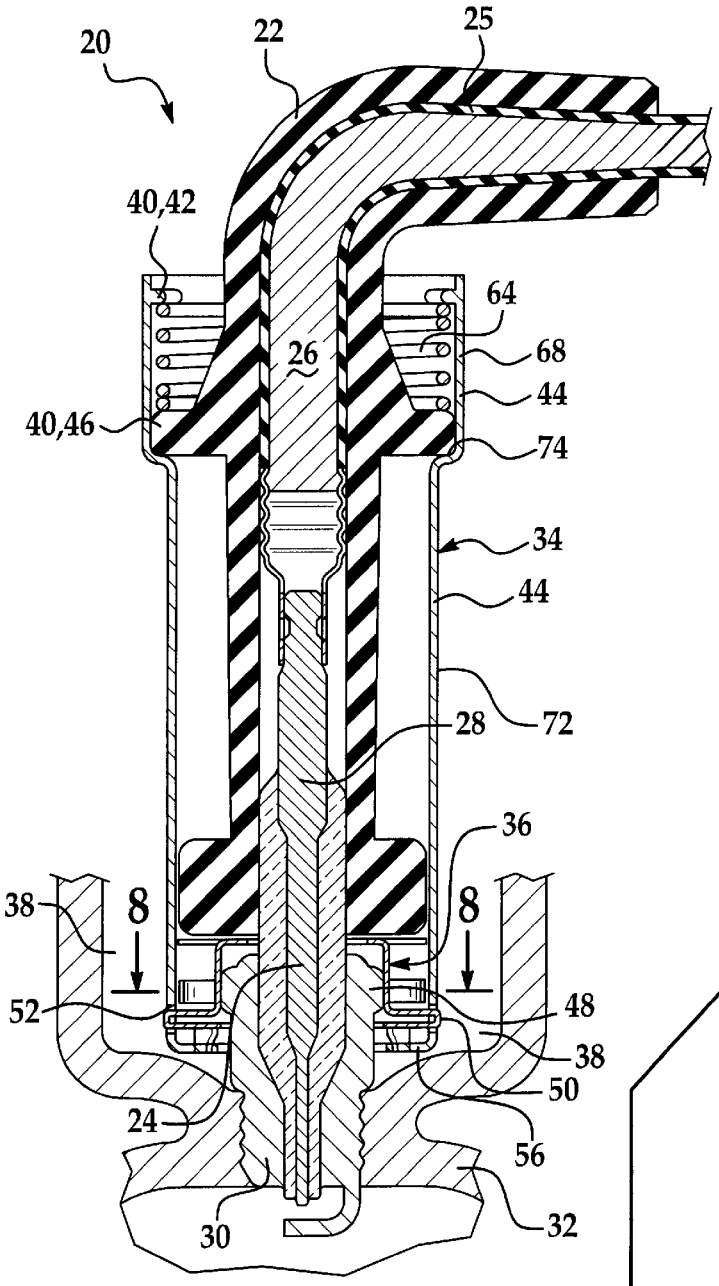
FIG. 1 is a longitudinal cross section view of a first embodiment of a spark plug boot keeper assembly of the present invention.
Figure 2:
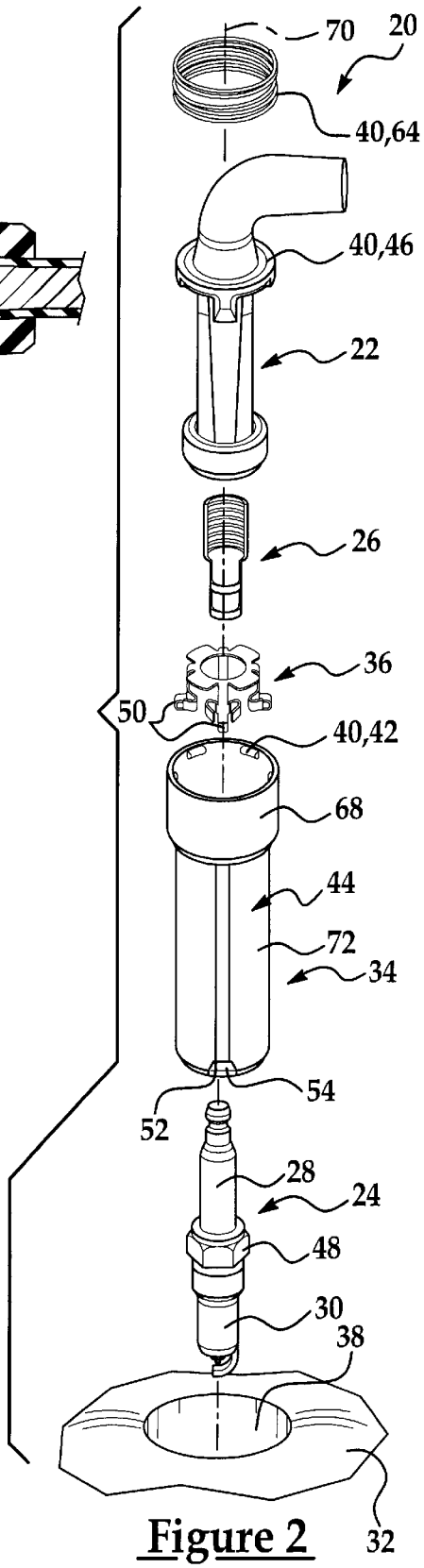
FIG. 2 is an exploded perspective view of the first embodiment of the spark plug boot keeper assembly.

Referring to FIGS. 1 and 2, a spark plug boot keeper assembly 20 of the present invention is illustrated and is capable of securing or locking a spark plug boot 22 onto a spark plug 24. A conventional ignition wire 25 and female terminal 26 is snap fitted to a spark plug terminal portion 28 disposed concentrically outward from a bottom portion 30 of the spark plug 24 threadably engaged and extended outward from an engine block head 32. The concept is such that a heat shield 34 of the assembly 20 secures about the bottom portion 30 of the spark plug 24 utilizing a spring clip 36, but only after the spark plug 24 has been threaded into the head 32. The present invention is particularly advantageous when the spark plug 24 is threaded within a well 38 defined by the engine block head 32 and easy or lateral access to the bottom portion 30 of the spark plug 24 is not required. The spring clip 36 engages between the heat shield 34 and the bottom portion 30 of the spark plug 24. The heat shield 34 thereby interconnects and locks the spark plug boot 22 to the bottom portion 30 of the spark plug 24. This is in addition to the conventional snap fit connection of the female terminal 26 of the boot 22 to the terminal portion 28 of the spark plug 24.

A locking combination 40 prevents axial outward movement of the boot 22 with respect to the heat shield 34, and includes an obstruction member 42 of the heat shield 34, a spring 64, and an axial outward facing surface 46 of the boot 22. The obstruction member 42 is a series of nubbles engaged to a cylindrical wall 44 of the heat shield 34 substantially near an upward distal end. The obstruction member 42 substantially extends radially inward from the wall 44 and is disposed axially outward with respect to the outward facing surface 46. The spring 64 is engaged compressibly between the obstruction member 42 of the heat shield 34 and the axial outward facing surface 46 of the boot 22. The axially outward facing surface 46 of the locking combination 40 is defined by the boot 22 and engages or interconnects with the obstruction member 42.

Prior to assembly or engagement of the heat shield 34 to the pre-installed spark plug 24, the rotational spring clip 36 is inserted into the heat shield 34. Engagement of the rotational spring clip 36 to the wall 44 of the heat shield 34 axially and radially aligns the rotational spring clip 36 to the heat shield 34. To assemble, an axial inward force is exerted upon the heat shield 34 causing a circumferentially elongated contact edge 47 of the rotational spring clip 36 to snap fit axially past a hexagonal portion 48 of the spark plug 24, the hexagonal portion 48 being disposed concentrically between the bottom portion 30 and the terminal portion 28. The hexagonal portion 48 has a diameter greater than the diameter of the bottom portion 30. During this assembly, axial outward movement of the rotational spring clip 36 with respect to the heat shield 34 is prevented by a locking extension 50 of the rotational spring clip 36 which protrudes radially outward and laterally contacts an inward facing surface 52 of the wall 44. Preferably, the inward facing surface 52, in part, defines a slot 54 which extends radially through the wall 44. The locking extension 50 extends into the slot 54. With the rotational spring clip 36 engaged to the spark plug 24, the locking combination 40 is then engaged.

To align and hold steady the heat shield 34 to the spark plug 24, the rotational spring clip 36 resiliently engages a bottom shelf 56 of the heat shield 34. The bottom shelf 56 extends radially inward from the wall 44 of the heat shield 34 substantially near the bottom of the engine well 38 and has an inner perimeter 58 which defines a hole 60. The diameter of the hole 60 is larger than the diameter of the hexagonal portion 48 of the spark plug 24 so that the hexagonal portion 48 of the spark plug 24 can pass through the hole 60 without interference from the bottom shelf 56 of the heat shield 34.

The obstruction member or nubbles 42 are co-planar to one another and protrude radially inward from an outward wall 68 of the wall 44 of the heat shield 34. The heat shield 34 has a centerline 70, and the wall 44 of the heat shield 34 further has an axial inward wall 72 and an upward shelf 74, both aligned about the centerline 70. The inward wall 72 is engaged unitarily between the bottom shelf 56 and the upward shelf 74. The bottom shelf 56 extends radially inward from the inward wall 72 and the upward shelf 74 extends radially outward from the inward wall 72. The outward wall 68 extends concentrically axially upward from the outward shelf 74.

To guide and snap fit the locking extensions 50 of the rotational spring clip 36 into the respective slots 54, the inward wall 72 defines an axially extending groove 76 for each extension 50. The grooves 76 face radially inward, are aligned circumferentially to the respective slots 54, and axially extend inward from and through the upward shelf 74 to substantially near the respective slots 54, preferably terminating just short thereto. Because the outward wall 68 has an inner diameter greater than the inner diameter of the inward wall 72, the rotational spring clip 36 with its radially protruding locking extensions 50 passes axially inwardly by the outward wall 68, during assembly, and into the respective grooves 76 through the upward shelf 74. As an alternative design, the inward and outward walls 72, 68 can be of the same diameter wherein the grooves 76 also extend the axial length of the outward wall 68.

Figure 3:
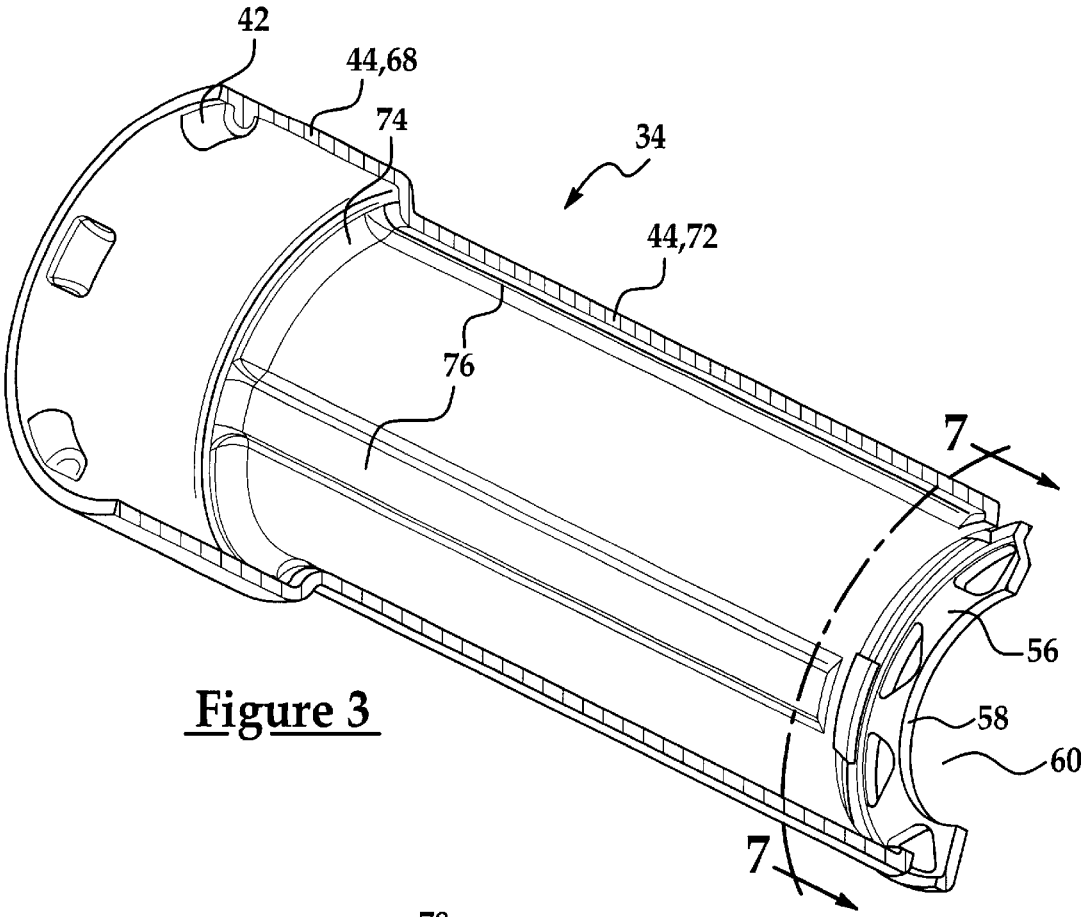
FIG. 3 is a longitudinal cross section view of a heat shield of the first embodiment of the spark plug boot keeper assembly.
Figure 4:
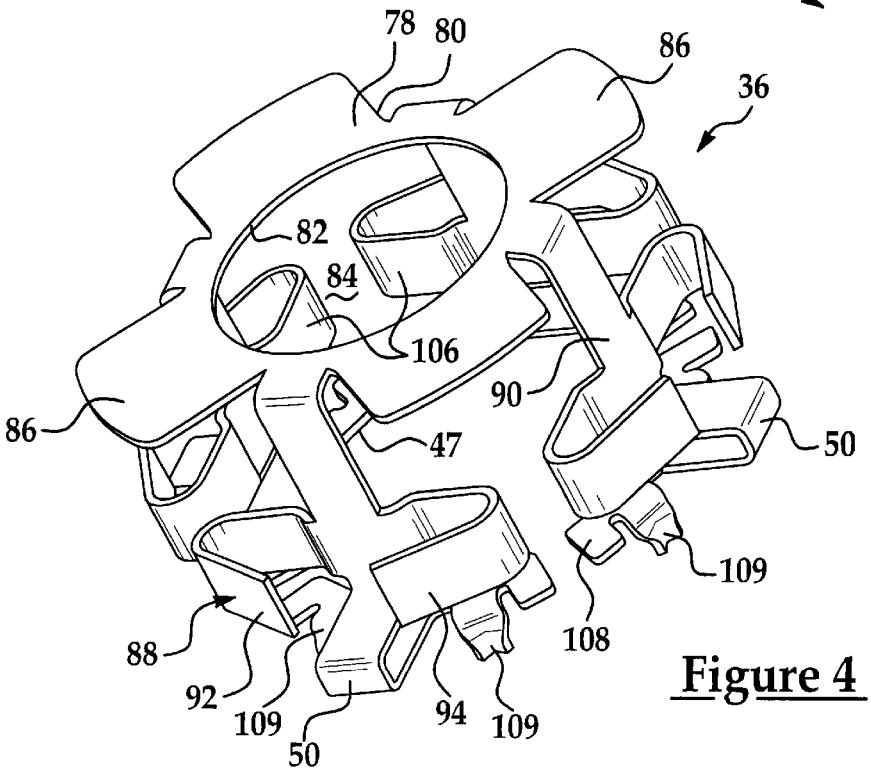
FIG. 4 is a perspective view of a rotational spring clip of the first embodiment of the spark plug boot keeper assembly.
Figure 5:
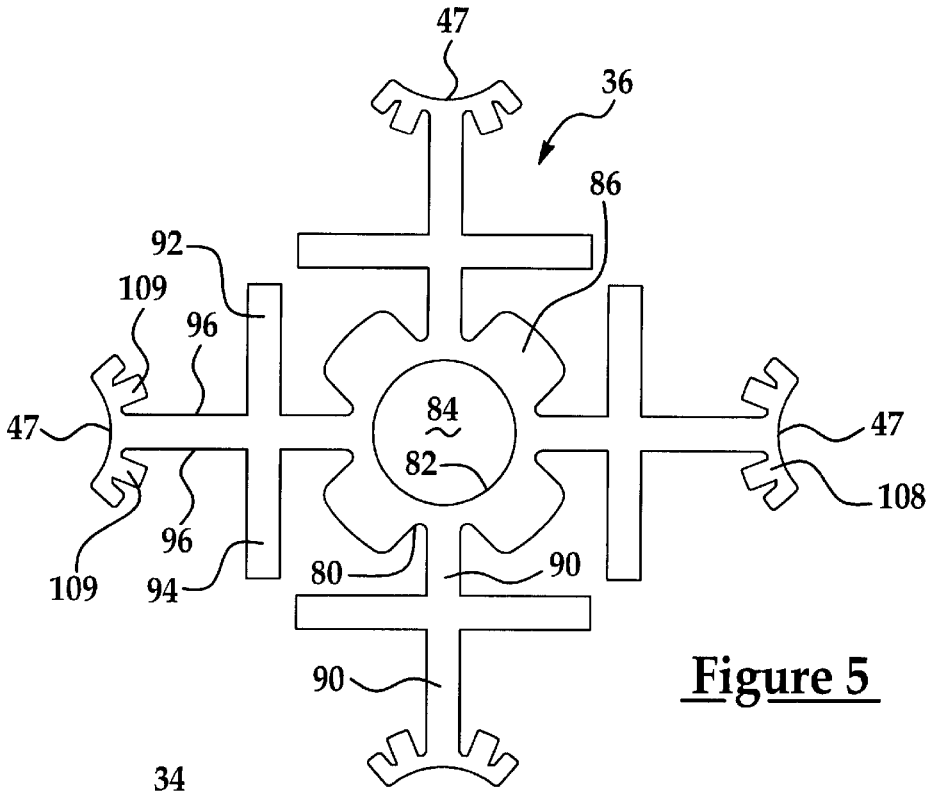
FIG. 5 is a blank view of the rotational spring clip.

Referring to FIGS. 3–5, the rotational spring clip 36 has a base plate 78 extended radially inward from an outer periphery 80 to an inner perimeter 82. The inner perimeter 82 defines an aperture 84 centered about the centerline 70. In assembly, the terminal portion 28 of the spark plug 24 extends through the aperture 84 and aligns axially with the inner perimeter 82. To stabilize and radially align the rotational spring clip 36 within the inward wall 72, a plurality of wings 86, preferably four wings, extend radially outward from the outer periphery 80 slideably engaging the inward wall 72 at circumferentially and equally spaced intervals.

Engaged to the outer periphery 80 of the base plate 78, between each wing 86 is an engagement assembly 88. Each engagement assembly 88 has a support member 90 extended axially inward from the outer periphery 80. As assembled, the engagement assembly 88 is engaged biasingly to the hexagonal and bottom portions 48, 30 of the spark plug 24 by V-shaped first and second retention arms 92, 94 which extend circumferentially and radially outward from either longitudinal side 96 of the support member 90 engaging resiliently the inward wall 72.

The elongated first and second retention arms 92, 94 each have a first portion 98 formed unitarily to the respective longitudinal side 96 of the support member 90 and angled slightly radially inward to the centerline 70 from the support member 90. Randomly engaging the hexagonal portion 48 of the spark plug 24, thereby preventing rotation of the rotational spring clip 36 with respect to the spark plug 24, is a second portion 100 of each arm 92, 94. The second portion 100 extends from the first portion 98 and angles slightly radially outward so that the second portion 100 of first arm 92 is coplanar with the second portion 100 of second arm 94. A third portion 102 extends from the second portion 100 and extends radially outward to a fourth portion 104 which angles back inward upon itself forming the V- shape. The fourth portions 104 are disposed substantially tangential to the inward wall 72 and are resiliently engaged thereto. Not only are the co-planar second portions 100 randomly engaged to the hexagonal portion 48 of the spark plug 24, but a radially inward face 106 of the support member 90 is also randomly engaged to the varying circumferential surface of the hexagonal portion 48.

The contact edge 47 of the rotational spring clip 36 extends along a planar element 108 engaged substantially perpendicularly to the distal end of the support member 90. During engagement of the heat shield 34 to the spark plug 24, the contact edge 47 rasps or reeves axially along the hexagonal portion 48 causing the engagement assembly 88 to pivot radially outward at a pivot axis located where the support member 90 engages the base plate 78 of the rotational spring clip 36. When the contact edge 47 snap fits radially inwardly upon the bottom portion 30 of the spark plug 24, the second portions 100 of the first and second retention arms 92, 94 and the inward face 106 of the support member 90 move radially inward engaging the hexagonal portion 48 of the spark plug 24. The fourth portions 104 of the first and second retention arms 92, 94 continue to exert a force radially outward against the inward wall 72 thereby assuring a snug fit with the hexagonal portion 48. The engagement with the hexagonal portion 48 prevents rotational movement of the rotational spring clip 36 with respect to the spark plug 24.

During assembly, when the contact edge 47 is rasping over the hexagonal portion 48, the pre-assembled locking extension 50 is pressed against the inward facing surface 52 of the slot 54 thereby assuring that the rotational spring clip 36 remains aligned axially within the heat shield 34. The locking extension 50 extends radially outward from the support member 90 of the engagement assembly 88 and is disposed axially outward with respect to the planar element 108 and axially inward with respect to the first and second retention arms 92, 94.

When the rotational spring clip 36 is fully engaged to the spark plug 24, at least one and preferably two release guide pins 109 of each engagement assembly 88 project axially inward and substantially perpendicular from the planar element 108 into a respective isosceles triangular shaped orifice 110 communicating through the bottom shelf 56 of the heat shield 34. The two equal sides of the orifice 110 form a first contact face 112 and a second contact face 114. The remaining side of the triangle is substantially tangential but spaced radially away from the inner perimeter 58 of hole 60 of the bottom shelf 56. The intersection of the first and second contact faces 112, 114 form a common leading end 116 which defines the most radially inward location of the orifices 110. In essence, the first contact face 112 extends from the common leading end 116 to a trailing end 118 which is disposed radially outward and circumferentially apart from the common leading end 116. Likewise, the second contact face 114 extends from the common leading end 116 to a trailing end 120 which is disposed radially outward and circumferentially apart from the common leading end 116. The inner perimeter 58 of the bottom shelf 56 is disposed radially inward from the common leading ends 116. The release guide pin 109 is generally engaged to the first and second contact faces 112, 114 at the common leading end 116 when the rotational spring clip 36 is fully engaged to the spark plug 24.

After the heat shield 34 and rotational spring clip 36 are assembled to the spark plug 24, the boot 22 with the female terminal 26 is locked to the terminal portion 28 of the spark plug 24 by the locking combination 40. The spring 64 of the locking combination 40 is snap or interference fitted axially inwardly past the obstruction member 40 of the heat shield 34 engaging the upward facing surface 46 of the boot 22. The spring 64 is thereby compressed between the obstruction member 42 and the upward facing surface 46 providing a constant axially inward force upon the boot 22 ensuring it does not unseat from the terminal portion 28 of the spark plug 24.

Figure 6:
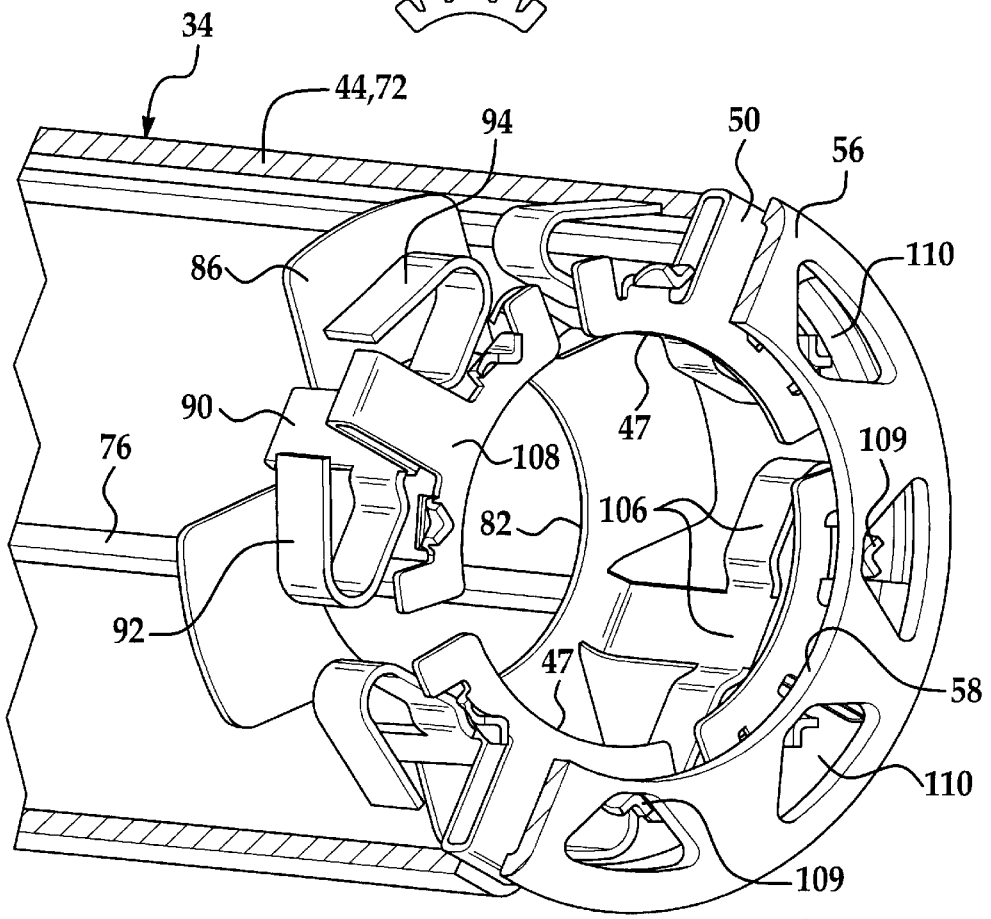
FIG. 6 is a partial perspective bottom view of the heat shield with a rotational spring clip pre-installed with the spark plug omitted to show detail of the first embodiment of the spark plug boot keeper assembly.
Figure 7:
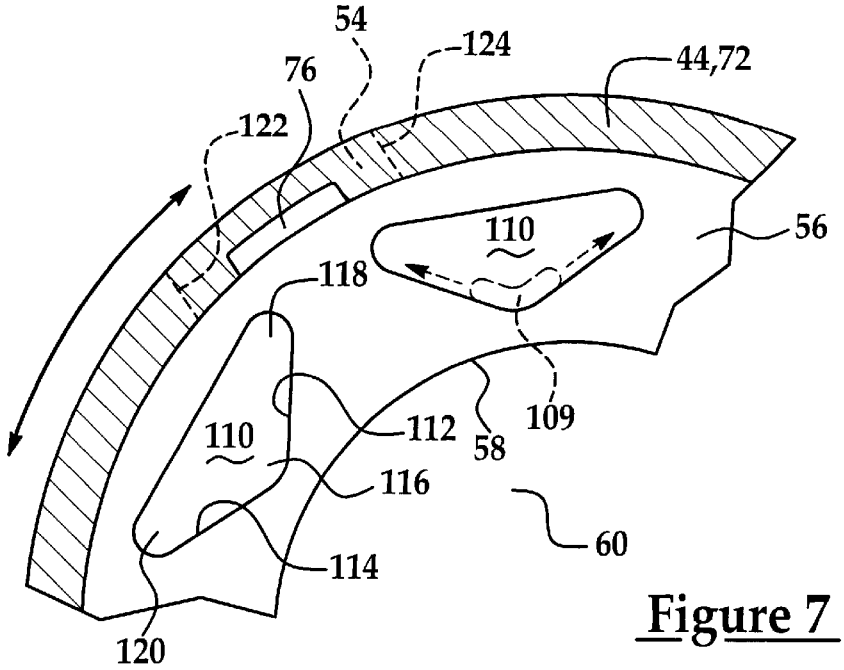
FIG. 7 is a partial cross section view of the heat shield of the first embodiment taken along line 7—7 viewing in the direction of the arrows of FIG. 3.
Figure 8:
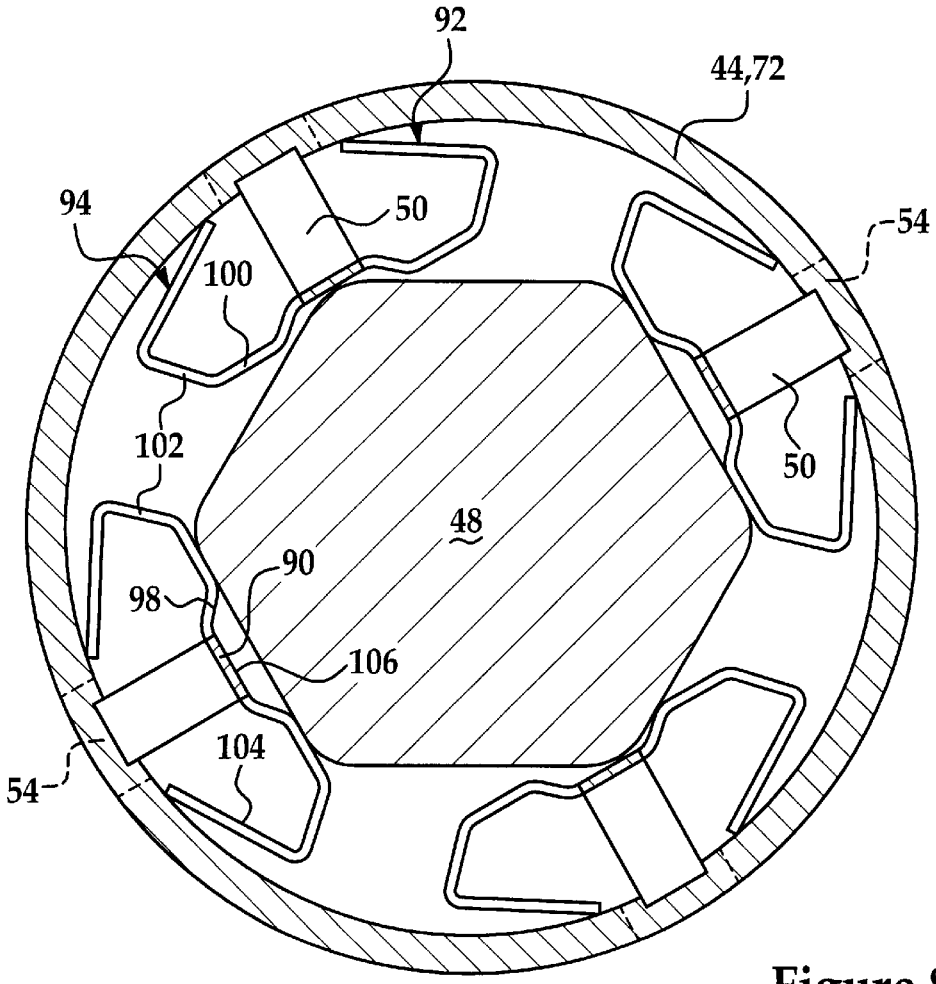
FIG. 8 is a cross section view of the first embodiment of the spark plug boot keeper assembly taken along line 8—8 viewing in the direction of the arrows shown in FIG. 1.
Figure 9:
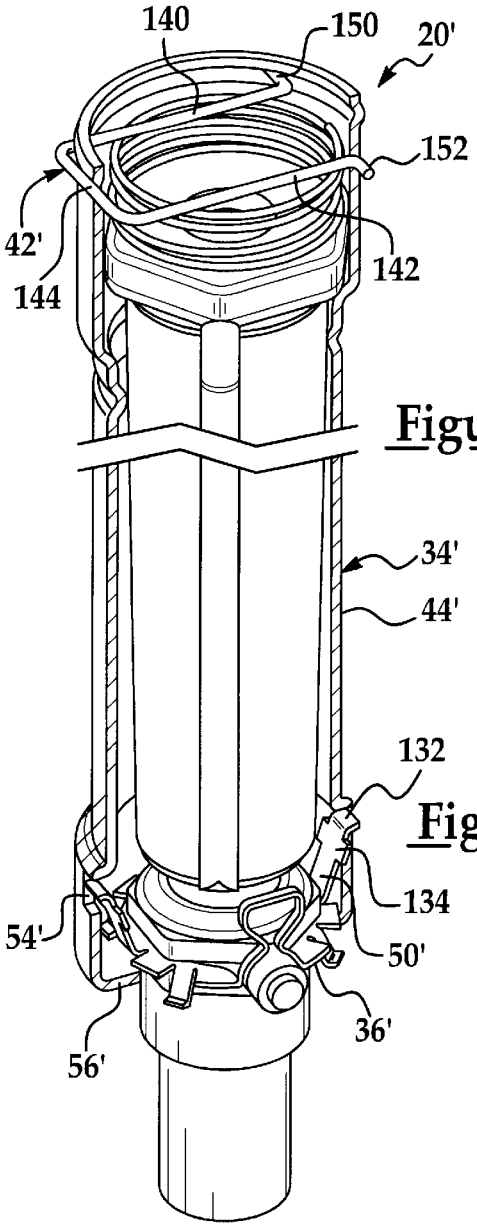
FIG. 9 is a perspective view of a second embodiment of the spark plug boot keeper assembly with a heat shield cut-away to show internal detail of the present invention.
Figure 10:
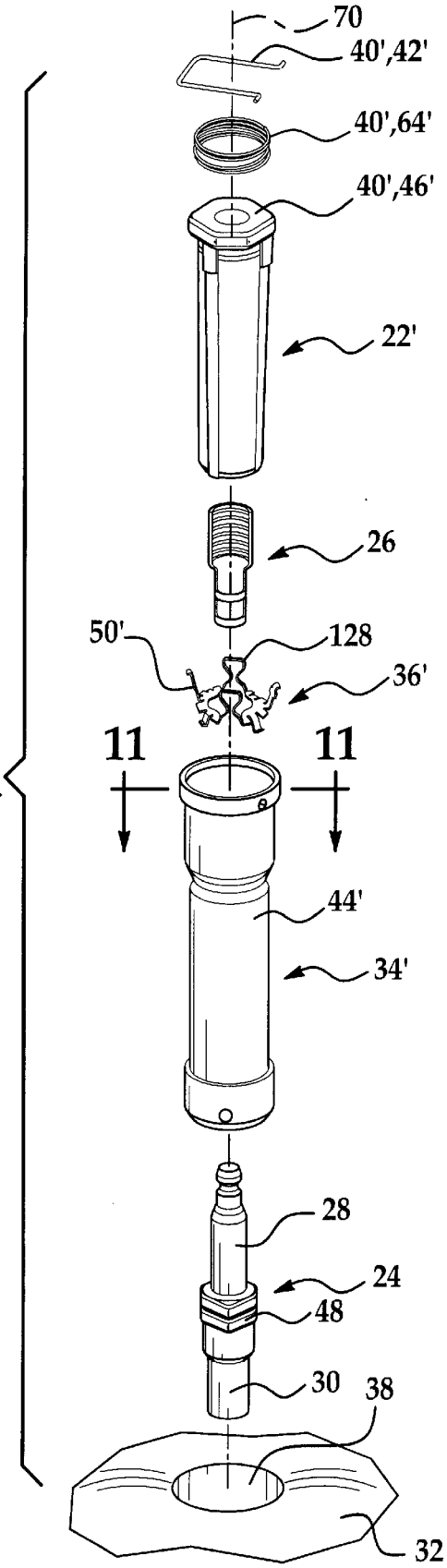
FIG. 10 is an exploded perspective view of the second embodiment of the spark plug boot keeper assembly.
Figure 11:
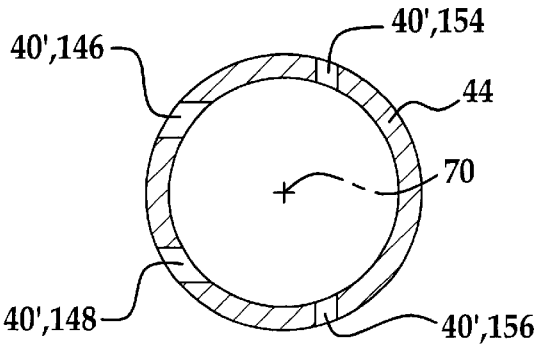
FIG. 11 is a cross section view of the heat shield of the second embodiment taken along line 11—11 viewing in the direction of the arrows shown in FIG. 10.
Figure 12:
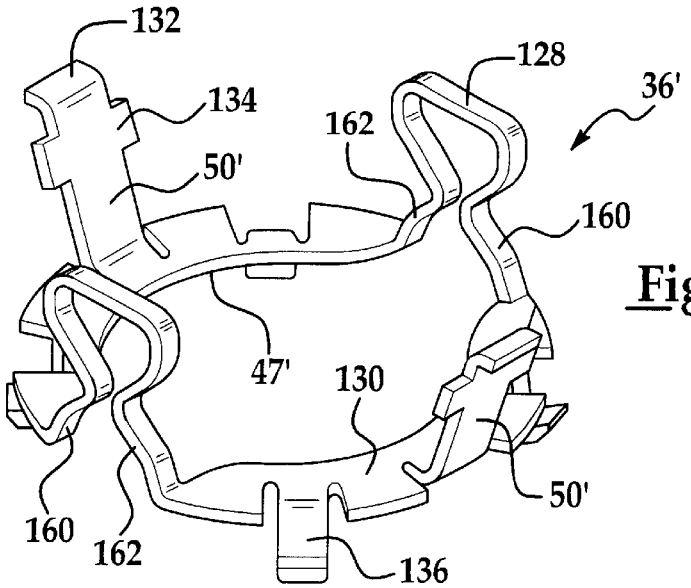
FIG. 12 is a perspective view of an axial spring clip of the second embodiment.
Figure 13:
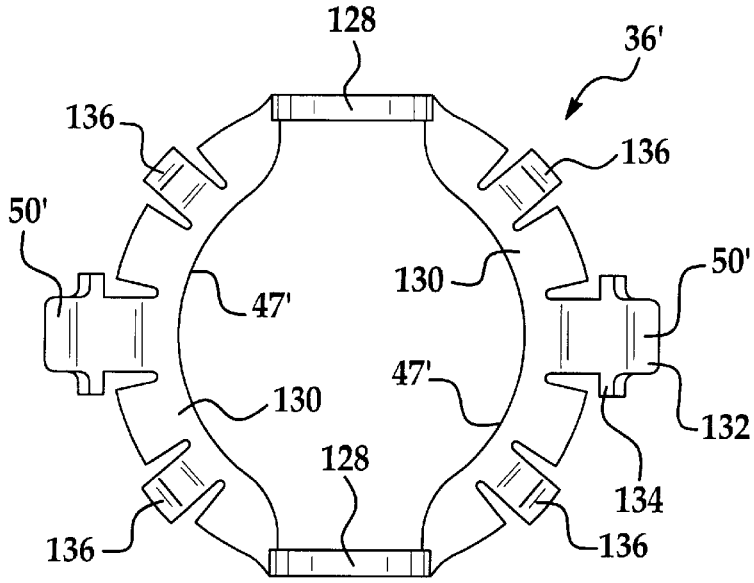
FIG. 13 is a top view of the axial spring clip of the second embodiment.
Figure 14:
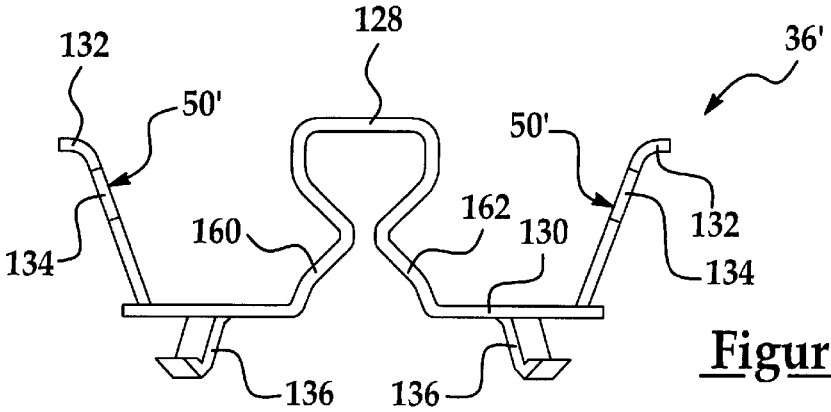
FIG. 14 is a side view of the axial clip of the second embodiment.
Figure 15:
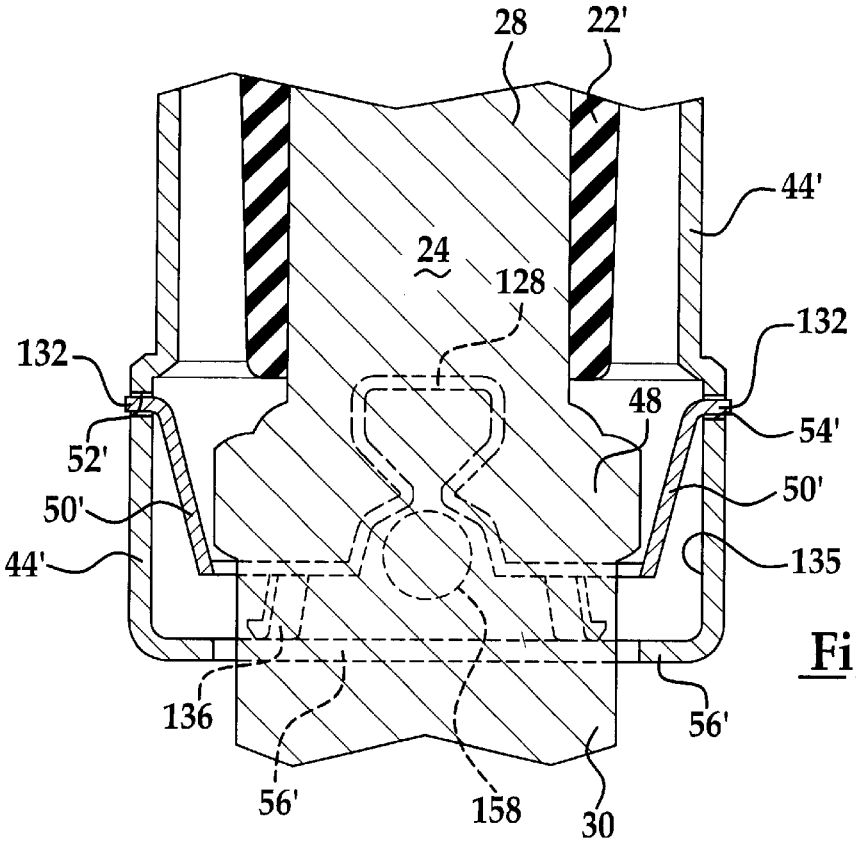
FIG. 15 is a partial longitudinal cross section view of the second embodiment of the spark plug boot keeper assembly.
Figure 16:
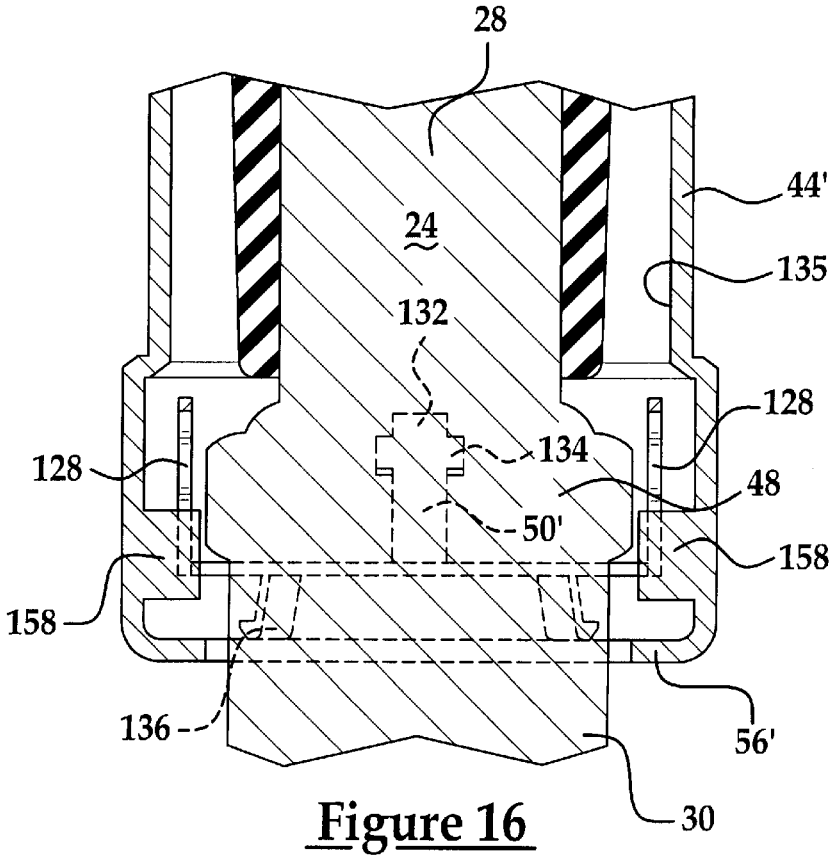
FIG. 16 is a partial longitudinal cross section view of the second embodiment of the spark plug boot keeper assembly as shown in FIG. 15 but rotated ninety degrees about a centerline.

Referring to FIGS. 3, 6 and 7, disengagement of the heat shield 34 from the spark plug 24 is accomplished by a slight rotation of the heat shield 34 with respect to the spark plug 24. This rotation is generally limited to a few degrees and is restricted by the length of the elongated slots 54 and the circumferential clearance provided therein for movement of the locking extension 50 of the rotational spring clip 36. The disengagement rotation may be one direction or both directions. If both directions, the first and second contact faces 112, 114 must be provided. As best shown in FIG. 7, when rotating the heat shield 34 in a clockwise direction, the release guide pin 109 slides or rasps along the second contact face 114 from the common end 116 to the trailing end 120 thereby causing the engagement assembly 88 to pivot radially outward. Likewise, when rotating the heat shield 34 in a counter-clockwise direction, the release guide pin 109 slides or rasps along the first contact face 112 from the common end 116 to the trailing end 118 causing the engagement assembly 88 to also pivot radially outward. Concededly, as the heat shield 34 is rotated in the clockwise or counter-clockwise direction, the locking extension 50 moves from the circumferential center of slot 54 to either respective slot end 122, 124. As the engagement assembly 88 pivots, the contact edge 47 moves radially outward until it radially clears the hexagonal portion 48 of the spark plug 24. Once cleared, the heat shield 34 along with the rotational spring clip 36 can be withdrawn axially from the spark plug 24. This configuration is particularly advantageous since the spark plug 24 does not require removal from the engine block head 32 when installing or removing the heat shield 34.

Referring to FIGS. 9–16, a second embodiment of the spark plug boot keeper assembly 20' is shown. The rotational spring clip 36 of the first embodiment is replaced with an axial spring clip 36' of the second embodiment. The axial spring clip 36' however serves the same purpose in that the heat shield 34' can be installed and disassembled from the spark plug 24 while the spark plug is engaged to the engine block head 32, preferably within the well 38. The axial spring clip 36' is substantially ring shaped having a series of expansion members 128 spaced altematingly between a series of base members 130. Preferably, the axial spring clip 36' has two expansion members 128 disposed circumferentially opposite from one another and two base members 122. Like the rotational spring clip 36, the heat shield 26' and the preinstalled axial spring clip 36' are snap fitted axially inward past the hexagonal portion 28 and about the base portion 30 of the spark plug 24. The contact edges 47' of the respective base member 130 face radially inward and engage the bottom portion 30 of the spark plug 24.

Each base member 130 preferably has one elongated locking extension 50' which like the locking extension 50 of the first embodiment, projects radially outward. In addition, however, the elongated locking extension 50' of the second embodiment also projects axially outward and has a distal end 132 which engages the axially inward facing surface 52'. A transverse member 134 unitarily transverses the locking extension 50' just short of the distal end 132 and engages the circumferential inward surface 135 of the wall 44' of the heat shield 34'. Similar to the first embodiment, the inward facing surface 52' partially defines the slot 54' extending radially through the wall 44'. The distal end 132 of the locking extension 50' snaps into the slot 54' as the transverse member 134 engages the circumferential inward surface 135.

Carrying the base members 130 and thereby providing axial support for the axial spring clip 36' against the bottom shelf 56' of the heat shield 34' are a series of support legs 136. The support legs 136 are engaged to the base members 130 and extend axially inward, resiliently contacting the bottom shelf 56'. Preferably, two support legs 136 are engaged to each respective base member 130, one support leg 136 on either side of the locking extension 50'. The support leg 136 circumferential placement ensures the axial spring clip 36' does not cock within the heat shield 34' and remains disposed resiliently and axially between the inward facing surface 52' and the bottom shelf 56'. The axial spring clip 36' is thereby disposed resiliently between the bottom shelf 56' and the axially inward facing surface 52' of the slot 54'.

Axially locking the boot 22' to the heat shield 34' is a locking combination 40' which has a U-shaped bail wire as the obstruction member 42'. The obstruction member 42' laterally penetrates the wall 44' of the heat shield 34' and is disposed axially outward from the boot 22'. The obstruction member 42' has a first leg 140 and a second leg 142 interconnected between a hip portion 144. The first leg 140 is substantially parallel to the second leg 142. In assembly, the hip 144 is disposed radially outward from the wall 44'. The first and second legs 140, 142 extend laterally through respective elongated first and second leg holes 146, 148 (shown in FIG. 11). The distal ends of the first and second legs 140, 142 form respective first and second feet 150, 152. The first foot 150 extends outward and opposite the second foot 152, they being generally co-linear to one another. The first leg 140 and the first foot 150 are substantially coplanar to the second leg 142 and the second foot 152. The first and second legs 140, 142 are substantially disposed radially inward to the wall 44'. The first foot 150 extends into a first foot hole 154 of the wall 44'. Likewise, the second foot 152 extends into a second foot hole 156 of the wall 44'. The first and second foot holes 154, 156 extend along imaginary planes which are substantially perpendicular with respect to the imaginary planes upon which the respective first and second leg holes 146, 148 extend.

To install the obstruction member 42', the first and second foot 150, 152 are laterally moved through the first and second leg holes 146, 148 which are circumferentially elongated to permit the passage of the feet 150, 152. With the first and second legs 140, 142 disposed radially inward to the wall 44', the legs 140, 142 may be radially drawn inward or together thereby flexing the hip 144 and permitting the first and second feet 150, 152 to generally align radially inward with respect to the first and second foot holes 154, 156. Releasing the legs will cause the first and second feet 150, 152 to move into the respective holes, 154, 156 thereby locking the obstruction member 42' to the wall 44' of the heat shield 34'.

The first and second legs 140, 142 engage the outward facing surface 46' of the boot 22'. Like the spring 64 of the first embodiment, an optional spring 64' of the second embodiment may be utilized if low tolerances of the spark plug boot keeper assembly 20' make use of a spring beneficial. In such a case, the spring 64' would be disposed axially between the first and second legs 140, 142 and the outward facing surface 46' of the boot 22'. The spring 64' exerts a constant force axially inward upon the boot 22'.

In assembly, a series of pins 158 project radially inward from the wall 44' of the heat shield 34' substantially near the bottom shelf 56'. The pins 158 are aligned circumferentially to and axially inward from each respective expansion member 128. Each expansion member 128 has a first arm 160 and a second arm 162. The arms 160, 162 extend axially upward and converge circumferentially from opposing base members 130 thereby forming a general U or V-shape in which the pin 158 engages axially when the heat shield 34' is being disengaged from the spark plug 24. In assembly, the first and second arms 160, 162 contact, or are substantially near to, the cylindrical surface of the pins 158. To disengage the heat shield 34' from the spark plug 24, the heat shield 34' is pulled axially upward or outward. This causes the pins 158 to engage the first and second arms 160, 162 of each expansion member 128 because the contact edge 47' of the axial spring clip 126 engages the bottom portion 30 of the stationary spark plug 24 beneath the radially protruding hexagonal portion 48.

Continuing to apply an axial outward withdrawal force to the heat shield 34' causes the pins 158 to move axially outward radially separating the first arm 160 from the second arm 162. The base members 130 forming the contact edges 47' therefore radially separate outwardly until the contact edges 47' clear or rasp axially outwardly over the hexagonal portion 48 of the spark plug 24. This permits withdrawal of the heat shield 34' with the axial spring clip 36' from the engine mounted spark plug 24.

Although the preferred embodiments of the present invention have been disclosed, various changes and modifications may be made thereto by one skilled in the art without departing from the scope and spirit of the invention as set forth in the appended claims. For instance, the locking combination 40 of the first embodiment may be interchanged with the locking combination 40' of the second embodiment having the spring 64'. Furthermore, it is understood that the terms used herein are merely descriptive, rather than limiting and various changes may be made without departing from the scope and spirit of the invention.

What is claimed is:

1. A spark plug boot keeper assembly comprising:

an elongated spark plug having a bottom portion extended axially outward from and engaged threadably to an engine block head;

an elongated boot extended axially outward from the spark plug the boot having an outward facing surface;

a spring clip engaged to the bottom portion of the spark plug, the spring clip having a locking extension extended radially outward;

an elongated heat shield having a wall and a bottom shelf extended radially inward from the wall, the wall extended axially outward from the bottom shelf, the wall having an axial inward facing surface engaged to the locking extension of the spring clip, the spring clip engaged resiliently to the bottom shelf; and a locking combination having an obstruction member of the heat shield and an outward facing surface of the boot, the obstruction member extended radially inward from the wall, disposed axially outward from the outward facing surface of the boot, and disposed axially outward from the axial inward facing surface of the wall, the obstruction member being interconnected to the outward facing surface of the boot.

2. The spark plug boot keeper assembly as set forth in claim 1 wherein the spring clip has an elongated contact edge extending circumferentially about and engaged to the bottom portion of the spark plug, the contact edge capable of expanding radially outward thereby releasing the heat shield from the spark plug.

3. The spark plug boot keeper assembly as set forth in claim 2 wherein the axial inward facing surface of the wall defines a slot extended radially into the wall of the heat shield.

4. The spark plug boot keeper assembly as set forth in claim 3 wherein the locking combination has a spring compressed axially and engaged between the obstruction member of the heat shield and the outward facing surface of the boot.

5. The spark plug boot keeper assembly as set forth in claim 4 wherein the spring clip is a rotational spring clip having an engagement assembly disposed radially between and aligned axially to the heat shield and the spark plug, the locking extension engaged to the engagement assembly and extended into the slot.

6. The spark plug boot keeper assembly as set forth in claim 5 further comprising:

the engagement assembly having a release guide pin extended axially inward and disposed axially inward and radially inward with respect to the locking extension; and the bottom shelf of the heat shield having an elongated first contact face facing radially outward, the first contact face extended between a common leading end and a first trailing end, the common leading end disposed radially inward and circumferentially apart from the first trailing end, the release guide pin of the rotational spring clip engaged slideably to the first contact face of the heat shield, wherein disengagement rotation of the heat shield with respect to the rotational spring clip causes the locking extension of the rotational spring clip to move circumferentially within the elongated slot of the heat shield and the release guide pin to slide resiliently against the first contact face of the heat shield from the common leading end to the first trailing end causing the contact edge to move radially outward disengaging the heat shield from the spark plug.

7. The spark plug boot keeper assembly as set forth in claim 6 wherein the spark plug has a hexagonal portion extended concentrically to and axially outward from the bottom portion of the spark plug, and wherein the engagement assembly has a first retention arm extended resiliently between the hexagonal portion of the spark plug and the wall of the heat shield thereby preventing the rotational spring clip from rotating with respect to the spark plug during disengagement rotation of the heat shield with respect to the rotational spring clip.

8. The spark plug boot keeper assembly as set forth in claim 7 further comprising:

a base plate of the rotational spring clip disposed perpendicular to the centerline, the base plate having an inner perimeter defining an aperture, the spark plug extended concentrically through the aperture; and a plurality of engagement assemblies, wherein the engagement assembly is included as one of the plurality of engagement assemblies, each one of the plurality of engagement assemblies spaced circumferentially from one another and extended axially downward from the base plate.

9. The spark plug boot keeper assembly as set forth in claim 8 wherein the base plate has an outer periphery defining a plurality of wings, each one of the plurality of wings spaced circumferentially from the other and extending radially outward, engaged slideably and disposed perpendicualr to the wall of the heat shield.

10. The spark plug boot keeper assembly as set forth in claim 9 wherein the bottom shelf has a second contact face circumferentially opposing the first contact face, the second contact face extended from the common leading end of the first contact face to a trailing end of the second contact face disposed radially outward from the leading end, wherein both clockwise or counter-clockwise rotation of the heat shield with respect to the rotational spring clip will disengage the rotational spring clip from the spark plug permitting axial withdrawal of the heat shield from the spark plug.

11. The spark plug boot keeper assembly as set forth in claim 10 further comprising:

an elongated support member of the engagement assembly extended axially downward from the outer periphery and circumferentially between the plurality of wings of the base plate; and a second retention arm of the engagement assembly, the first and second retention arms extended perpendicularly and circumferentially from opposing longitudinal sides of the support member.

12. The spark plug boot keeper assembly as set forth in claim 11 wherein the wall has an axial outward wall, an axial inward wall and an outward shelf, the bottom shelf engaged to the inward wall, the inward wall extended axially outward from the bottom shelf to the outward shelf, the outward shelf extended radially outward from the inward wall to the outward wall, the outward wall extended axially outward from the outward shelf, the inward wall having a groove, the groove facing radially inward and extended axially inward from the outward shelf toward the slot of the heat shield, the slot aligned circumferentially with the groove, wherein the locking extension is resiliently guided downward within the groove and then snap fitted into the slot during assembly.

13. The spark plug boot keeper assembly as set forth in claims 12 wherein the obstruction member is a plurality of nubbles aligned axially and spaced circumferentially apart from one another.

14. The spark plug boot keeper assembly as set forth in claims 12 wherein the obstruction member is a U-shaped bail wire having a first leg, a second leg and a hip, the first and second legs interconnected by the hip, the hip disposed radially outward from the outward wall of the heat shield, the first and second legs penetrating and extending radially inward to the outward wall, wherein the bail wire is inserted laterally into the heat shield at a radially inward direction, the outward facing surface disposed axially inward from and interconnected to the first and second legs.

15. The spark plug boot keeper assembly as set forth in claim 14 further comprising:

the bail wire having a first foot and an opposing second foot extended perpendicular and outward from the respective ends of the first and second legs opposite the hip, the first leg and first foot being planar to the second leg and second foot; and the outward wall of the heat shield having a circumferentially elongated first leg hole, a circumferentially elongated second leg hole, a first foot hole and a second foot hole, the first and second legs penetrating the respective first and second leg holes, the first and second feet passing through the respective first and second leg holes during assembly and extended into the respective first and second foot holes.

16. The spark plug boot keeper assembly as set forth in claim 3 further comprising:

the spring clip being an axial spring clip having a plurality of base members interconnected by a plurality of expansion members, each one of the plurality of expansion members having a first arm and a second arm, the first and second arms extended axially outward from the respective plurality of base members, the first arm radially diverging upon the second arm, the contact edge being one of a plurality of contact edges, each one of the plurality of contact edges disposed on each respective one of the plurality of base members; and the wall of the heat shield having a plurality of pins aligned circumferentially with and axially inward of the plurality of expansion members, each one of the plurality of pins extended radially inward and engaged to the first and second arms of each respective one of the plurality of expansion members.

17. The spark plug boot keeper assembly as set forth in claim 16 wherein each one of the plurality of base members have at least one flexible support leg extended axially inward and engaged resiliently to the bottom shelf.

18. The spark plug boot keeper assembly as set forth in claim 17 wherein the locking extension is one of a plurality of locking extensions, each one of the plurality of locking extensions extended axially upward and radially outward from each respective one of the plurality of base members.

19. The spark plug boot keeper assembly as set forth in claim 18 wherein the obstruction member is a U-shaped bail wire having a first leg, a second leg and a hip, the first and second legs interconnected by the hip, the hip disposed radially outward from the wall of the heat shield, the first and second legs penetrating and extending radially inward to the wall, wherein the bail wire is inserted laterally into the heat shield at a radially inward direction, the outward facing surface disposed axially inward from and interconnected to the first and second legs.

20. The spark plug boot keeper assembly as set forth in claim 19 further comprising:

the bail wire having a first foot and an opposing second foot extended perpendicular and outward from the respective ends of the first and second legs opposite the hip, the first leg and first foot being planar to the second leg and second foot; and the wall of the heat shield having a circumferentially elongated first leg hole, a circumferentially elongated second leg hole, a first foot hole and a second foot hole, the first and second legs penetrating the respective first and second leg holes, the first and second feet passing through the respective first and second leg holes during assembly and extended into the respective first and second foot holes.

21. The spark plug boot keeper assembly as set forth in claim 20 further comprising a spring engaged compressibly between the U-shaped bail wire and the outward facing surface of the boot.

* * * * *